US006865821B2

(12) United States Patent
Merschat

(10) Patent No.: US 6,865,821 B2
(45) Date of Patent: Mar. 15, 2005

(54) VACUUM LUMBER DRYING KILN WITH COLLAPSING COVER AND METHOD OF USE

(76) Inventor: John R. Merschat, Appalachian Timber Products, Markleysburg, PA (US) 15459

( * ) Notice: Subject to any disclaimer, the term of this patent is extended or adjusted under 35 U.S.C. 154(b) by 196 days.

(21) Appl. No.: 10/633,644

(22) Filed: Aug. 5, 2003

(65) Prior Publication Data

US 2005/0028399 A1 Feb. 10, 2005

(51) Int. Cl.[7] ..... F26B 7/00; F26B 13/30

(52) U.S. Cl. ..... 34/403; 34/411; 34/412; 34/417; 34/518; 34/92; 34/225; 34/231

(58) Field of Search ..... 34/306, 403, 411, 34/412, 417, 426, 518, 92, 202, 215, 223, 224, 225, 406

(56) References Cited

U.S. PATENT DOCUMENTS 4,194,296 A 3/1980 Pagnozzi et al.
4,343,095 A 8/1982 Rosen et al.
5,123,177 A 6/1992 Koetter et al.
5,199,186 A * 4/1993 Rice et al. ..... 34/92
5,678,618 A 10/1997 Lindhe et al.
6,161,365 A 12/2000 Girard et al.
6,317,997 B1 * 11/2001 Kooznetsoff et al. ..... 34/92
6,640,462 B1 * 11/2003 Choi et al. ..... 34/406

* cited by examiner

*Primary Examiner*—Pamela A Wilson
(74) *Attorney, Agent, or Firm*—Richard C. Litman

(57) ABSTRACT

A lumber drying kiln employs outside air pressure uses a flexible collapsing bag or cover alone or in combination with walls. The collapsing bag seals against a base to maintain the vacuum. The air pressure against the flexible top keeps the lumber layers from warping or cupping during drying. The lumber stack has alternating layers of hot plates or stickers separating layers of lumber. A bag having an open bottom and made of nylon-reinforced rubber or other strong flexible material is placed over the wood and sealed to the stainless steel platform. A vacuum pump is connected with the bag by means of a manifold and operated to remove air from the enclosed lumber stack, the vacuum strengthening the seal between the base and the bottom of the bag. This chamber design is easily scaled up or down to provide a desired drying capacity.

20 Claims, 17 Drawing Sheets

*Fig. 2C*

VACUUM LUMBER DRYING KILN WITH COLLAPSING COVER AND METHOD OF USE

BACKGROUND OF THE INVENTION

1. Field of the Invention

The present invention relates to kilns for drying lumber. More particularly, the present invention relates to a vacuum chamber kiln.

2. Description of the Related Art

The use of lumber drying kilns is widespread for preparing lumber for use in building furniture, flooring, and other applications where warping of lumber during and after incorporation in the product or structure is not acceptable. In the past, lumber was air dried or cured in stacks, either outdoors in the weather, or indoors, taking lengthy time to reach the required dried or cured conditions. Drying kilns have speeded the drying or curing of wood to a relatively short time and produce more consistent quality lumber.

There are differing ways to kiln dry lumber. Steaming and dehumidification are examples. The drawbacks to these are the time and energy it takes to achieve the desired final moisture content in the wood. It typically takes from several weeks to months to dry lumber in these types of kilns, depending on the type of wood and the thickness of the lumber to be dried.

A relatively recent development in lumber drying kilns is the vacuum kiln. A vacuum kiln can reduce drying time from weeks to days and from months to weeks, depending on the thickness of the lumber to be dried. Present vacuum kilns have, however, various drawbacks. Vacuum kilns cost as much as twenty times that of conventional kilns and, typically, they are limited in size, having a capacity of 30,000 board feet or less of lumber.

In dehumidification kilns, layers of lumber are stacked on stickers (lumber separators which allow circulation of air or steam) to form a stack which is within the capacity of the kiln. The temperature inside the kiln is raised to between 110–185 degrees F. A large dehumidifier, similar to those used in homes, constantly removes excess moisture in the air while large fans circulate this dried air around the wood in the kiln which is then recycled to the dehumidifier. As the dry air passes around the wood, water molecules from the outer surface of the wood changes from liquid to water vapor and this moisture is removed in the dehumidifier where liquid water is removed from the system. Although outside fresh heated and dehumidified air could be supplied to the wood-containing compartment of the kiln and the resulting moisture-bearing air released into the atmosphere, this is relatively energy inefficient. In most kilns, the heated air is circulated between the wood-containing compartment and the dehumidifier, thus retaining heat within the system and requiring only the addition of heat in amounts necessary to make up for heat losses through radiation and removal of hot water. Because of the moisture gradient formed in the lumber during drying, water begins to travel from the inside towards the outer surface of the lumber being treated. This process is continued until the desired moisture content in the lumber is obtained, at which time the lumber is removed from the kiln for use.

In a vacuum kiln, layers of lumber are either stacked on stickers as in the dehumidification kiln, or on hot plates separating the layers of wood until the desired stack is obtained. The hot plates are typically large, flat hollow structures through which hot water is circulated by means of a hot water supply and conduits to and between the hot plates. Temperatures inside these kilns are similar to those reached in conventional dehumidification kilns. An airtight chamber capable of handling vacuums of up to 29.9 inches of mercury is employed to house the lumber during the drying process. These, chambers must be of high strength to withstand the atmospheric pressure without collapse. Also, the chamber must be constructed of an inert material such as stainless steel, due to the corrosive nature of the acids which are removed from the wood during the drying process. The main cost and size-limiting factor in vacuum kiln construction is the stainless steel chamber.

After the stack of lumber has been placed inside the kiln chamber and the door sealed, the drying process may begin. A vacuum is pulled on the lumber by means of a vacuum pump connected with the interior of the kiln chamber and exhausting to the outside. As the vacuum increases, the moisture in the lumber is boiled out of the lumber at temperatures below the boiling point of water (if the vacuum is sufficiently high, the water will boil at room temperature). The steam or water vapor released by the lumber inside the chamber is passed through a condenser and then pumped to the outside of the chamber. As the moisture inside the lumber boils and is released, the temperature of the lumber drops. This is due to the fact that latent energy in the moisture within the wood turns to steam and leaves the wood. To compensate for this loss in energy, heat, must be added to the chamber to prevent freezing of the wood or the slowing of the drying process. Since heat does not travel well through a vacuum, direct heating by contact of the layers of lumber is accomplished through the intervening heating plates. As mentioned above, these plates are typically hollow and allow heated water to pass through, typically in series by connecting conduits at the end or side of the lumber stack. These direct contact kilns are the fastest available but do take considerable effort to load and unload due to the effort involved in assembling and disassembling the lumber stack with the intervening hot plates.

Other vacuum kilns are operated with lumber layers separated by stickers in the conventional stacking technique and circulate a certain amount of hot air inside the chamber. They are typically slower than hot plate systems but are much quicker to load and unload.

Present vacuum kilns are, then, unpopular for two reasons. First, the initial cost of the kiln is prohibitive for many kiln operators. Second, the relatively small capacity of present vacuum kilns make them undesirable for many other kiln operators.

It would be desirable to provide a vacuum kiln design for drying or curing wood lumber which may be built for substantially less cost than present vacuum kilns. It would also be desirable if such a kiln design would be readily scalable to make small units affordable to a hobbyist as well large capacity units satisfactory for large lumber kiln operations.

SUMMARY OF THE INVENTION

The lumber drying kiln of the present invention solves the aforementioned problems by providing a vacuum kiln design which is of relatively low initial cost and is flexible in size and mode of operation so as to appeal to a large range of users from the small to the large lumber kiln operator.

In the present invention the stack of lumber, itself is employed to support the vacuum chamber using a flexible collapsing bag or cover alone or in combination with walls.

The collapsing bag seals against a base, which may be heated or unheated, to maintain the vacuum. In its simplest form a stainless steel platform or base is made to support a stack of lumber. The lumber stack has alternating layers of hot plates or stickers separating layers of lumber. A bag having an open bottom and made of nylon-reinforced rubber or other strong flexible material is placed over the wood and sealed to the stainless steel platform. A vacuum pump is connected with the bag by means of a manifold and operated to remove air from the enclosed lumber stack, the vacuum strengthening the seal between the base and the bottom of the bag. This chamber may be made as small or large as necessary to satisfy any user. This chamber is less expensive to construct and the lumber is flatter and has fewer top layer defects than prior systems.

More sophisticated chambers may have metal end walls, a rear wall, and inner perforated end walls constructed of stainless steel, the flexible cover sealing against these walls and the base to form a vacuum chamber. Such a system using stickers between layers of lumber preferably has means to recirculate introduced heated air and developed steam through the lumber stack while drawing a vacuum on the chamber employing a high capacity vacuum pump. A similar system employing hot plates heated by circulating hot water or electrical resistance heaters requires a vacuum pump to draw a vacuum, necessary heat being supplied by the conductive hot plates. Another system employs perforated hot plates connected to a source of heated air and a high capacity vacuum pump.

As lumber dries, it has a tendency to warp and twist in the kiln. As the lumber reaches its final moisture content, cupping and crook are locked into certain boards of lumber. The lumber at the bottom of the pile is always flatter than that at the top. For this reason, many kiln operators put heavy weights on the top layers of lumber. This does help relieve the problem, but reduces operational efficiency in two ways. First, the large concrete or steel weights take up valuable kiln space that could be used for drying wood. Second, the weights must be heated to whatever temperature the kiln is running, wasting energy.

Because the inventive kiln chamber design has the weight of the atmosphere bearing on the wood stack, the lumber is forced to maintain flatness throughout the stack. Running the chamber at 29 inches of mercury vacuum is equivalent to distributing 67.7 tons of weight on a typical 4'×16' stack of lumber, i.e. roughly 14.7 psi.

As previously discussed, either hot plates or stickers may be used in the lumber stack in the inventive kiln. In the preferred case, heat plates are used due to their superior performance. Present heat plates use hot water to warm the plate and thus the lumber. Although hot water plates may be used effectively in the present invention, such plates are heavy and hard to maneuver. These plates must have a male and female coupling linked together with the plate above and below in a series flow system, each union being water-tight. If a connecting hose fails, a union breaks, or a plate fractures during kilning of the lumber, staining of part of or the entire stack is possible. Serious mechanical damage to the vacuum pump may also result. Electrically heated plates may also be used in the present invention, although the presence of moisture and acids from the wood could cause damage to the circuitry and failure of the system if not carefully maintained.

The preferred plate of the present invention is hollow as in the hot water plates, but, instead of using water as the heating medium, air is employed. The plates each have a single air inlet which may be connected to an inlet manifold. The air may be supplied in a heated condition as desired. The top and bottom walls of the plate are perforated so as to evenly dissipate the heat. The air is drawn from the inlet manifold, through the perforations in the plates, and out of the kiln by action of the vacuum pump.

The vacuum pump is of an oversize capacity having the capability of maintaining the desired vacuum level inside the chamber while having enough extra capacity to pull warm or heated air into the manifold and through the heating plates to flush steam given off from the wood through the vacuum to the outside environment. The size and number of perforations in the plates and the number of plates determine the pressure drop through the plates and, thus, the level of vacuum maintained within the kiln for a particular vacuum pump size. This system eliminates the need for a condenser, thus saving cost in its initial installation and the energy to drive the condenser. The base may be heated to supply additional heat to the system and avoid condensation of steam on the floor of the base.

U.S. Pat. No. 5,678,618, issued Oct. 21, 1997, to Lindh et al., describes a method of producing hard wooden elements by compressing wooden blanks. The Lindh et al. device makes use of a plastic/elastic membrane which forms the bottom surface of the chamber and extends across the wooden piece, applying uniform pressure to all wooden parts to minimize defects.

U.S. Pat. No. 4,194,296, issued Mar. 25, 1980, to Pagnozzi et al., describes a vacuum drying kiln that draws air and water vapor from a kiln through the vacuum pump. Fans within the drying chamber circulate air, heated by a heating wall through the mechanics of heat transfer, between the stacks of lumber being dried.

U.S. Pat. No. 6,161,365, issued Dec. 19, 2000, to Girard et al., describes a hermetic bagging apparatus for bundles of lumber.

U.S. Pat. No. 4,343,095, issued Aug. 10, 1982, to Rosen et al., describes a pressure steam drying kiln for seasoning lumber.

U.S. Pat. No. 5,123,177, issued Jun. 23, 1992, to Koetter et al., describes a wood curing kiln operating under negative pressure having a concrete heated floor, means for circulating heated air within the chamber and through the stacked lumber with the camber being vented to remove moist air while maintaining a negative pressure, and a tarp suspended from the ceiling of the chamber above the stacked lumber which is lowered to cover and seal the top of the stacked lumber under high pressure so that all the heated air flows across the top of the tarp and down into and through an end of the lumber stack held at a low pressure.

Accordingly, it is a principal object of the invention to provide a vacuum lumber drying kiln which is relatively inexpensive in cost.

It is another object of the invention to provide a kiln, as above which is has high capacity.

It is a further object of the invention to provide a kiln as above which is easy to load and unload.

Still another object of the invention is to provide a kiln as above which may be easily scaled down for use by a hobbyist.

Yet another object of the invention is to provide a heated plate vacuum kiln as above which eliminates the possibility of spillage of hot water on the drying lumber and resulting stains.

Still another object of the invention is to provide a kiln as above which uses outside air to flush developed steam from the kiln.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention is a wood drying kiln having a flexible cover allowing the stack of lumber, itself, to be employed to support the vacuum chamber using a flexible collapsing bag or cover alone or in combination with walls. The collapsing bag seals against a base, which may be heated or unheated to maintain the vacuum. In its simplest form a stainless steel platform or base is made to support a stack of lumber. The lumber stack has alternating layers of hot plates or stickers separating layers of lumber. A bag having an open bottom and made of nylon-reinforced rubber or other strong flexible material is placed over the wood and sealed to the stainless steel platform. A vacuum pump is connected with the bag by means of a manifold and operated to remove air from the enclosed lumber stack, the vacuum strengthening the seal between the base and the bottom of the bag.

Figure 1A:
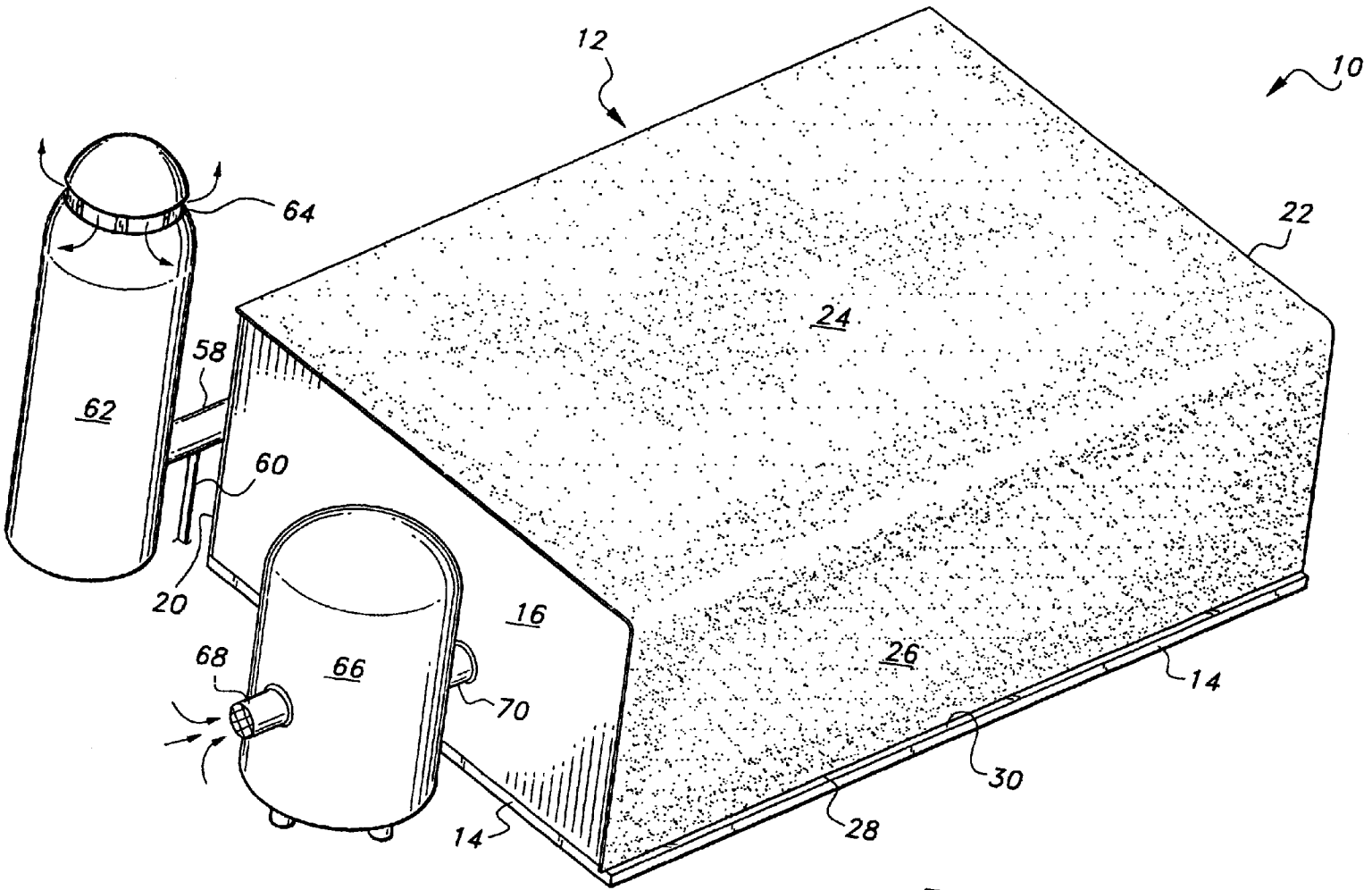
FIG. 1A is a perspective view of a vacuum lumber drying kiln according to the present invention.
Figure 1B:
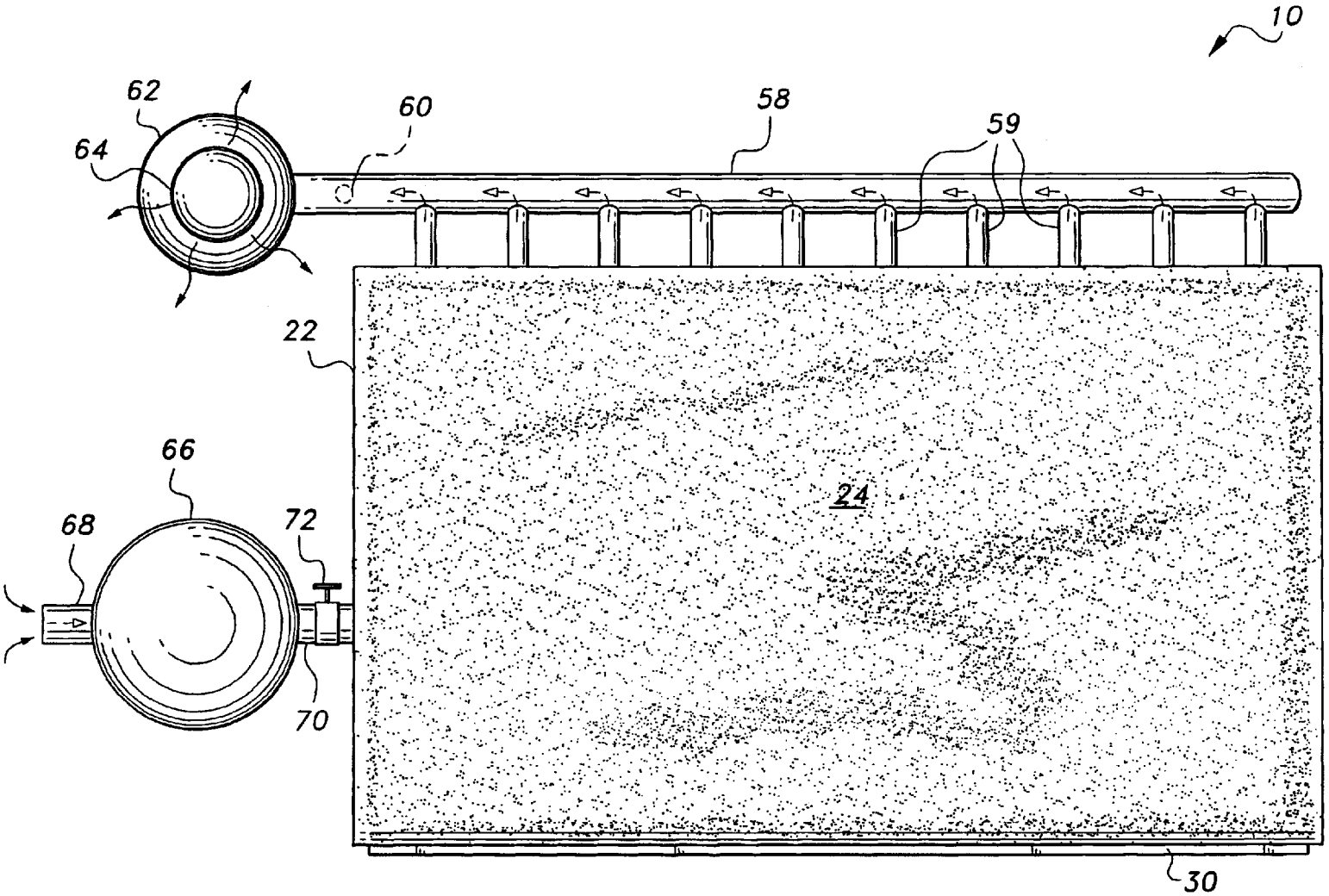
FIG. 1B is a plan view of the invention of FIG. 1A.
Figure 1C:
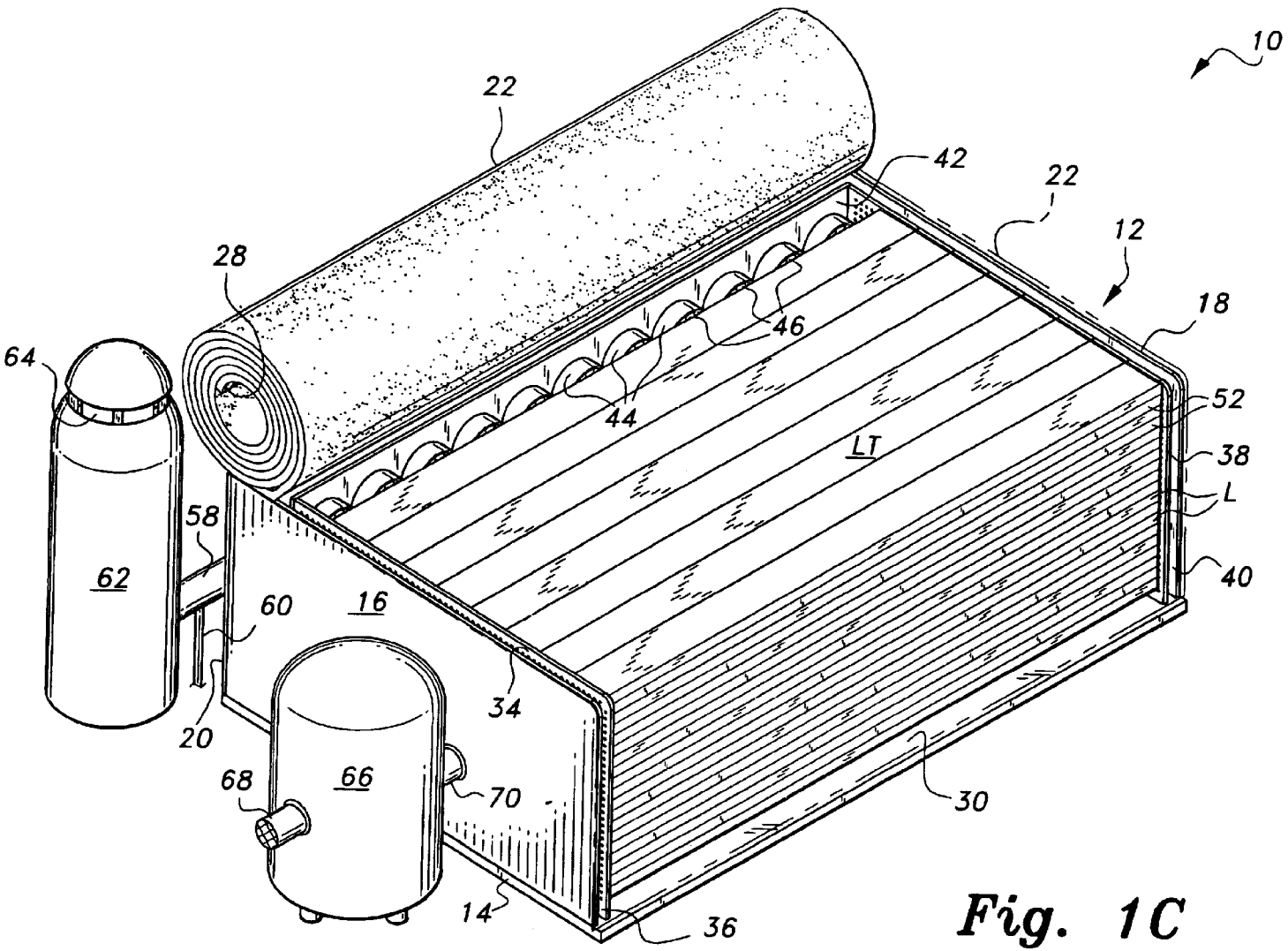
FIG. 1C is a perspective view of the kiln of FIG. 1A with the cover in the stored position for loading and unloading the kiln.
Figure 1D:
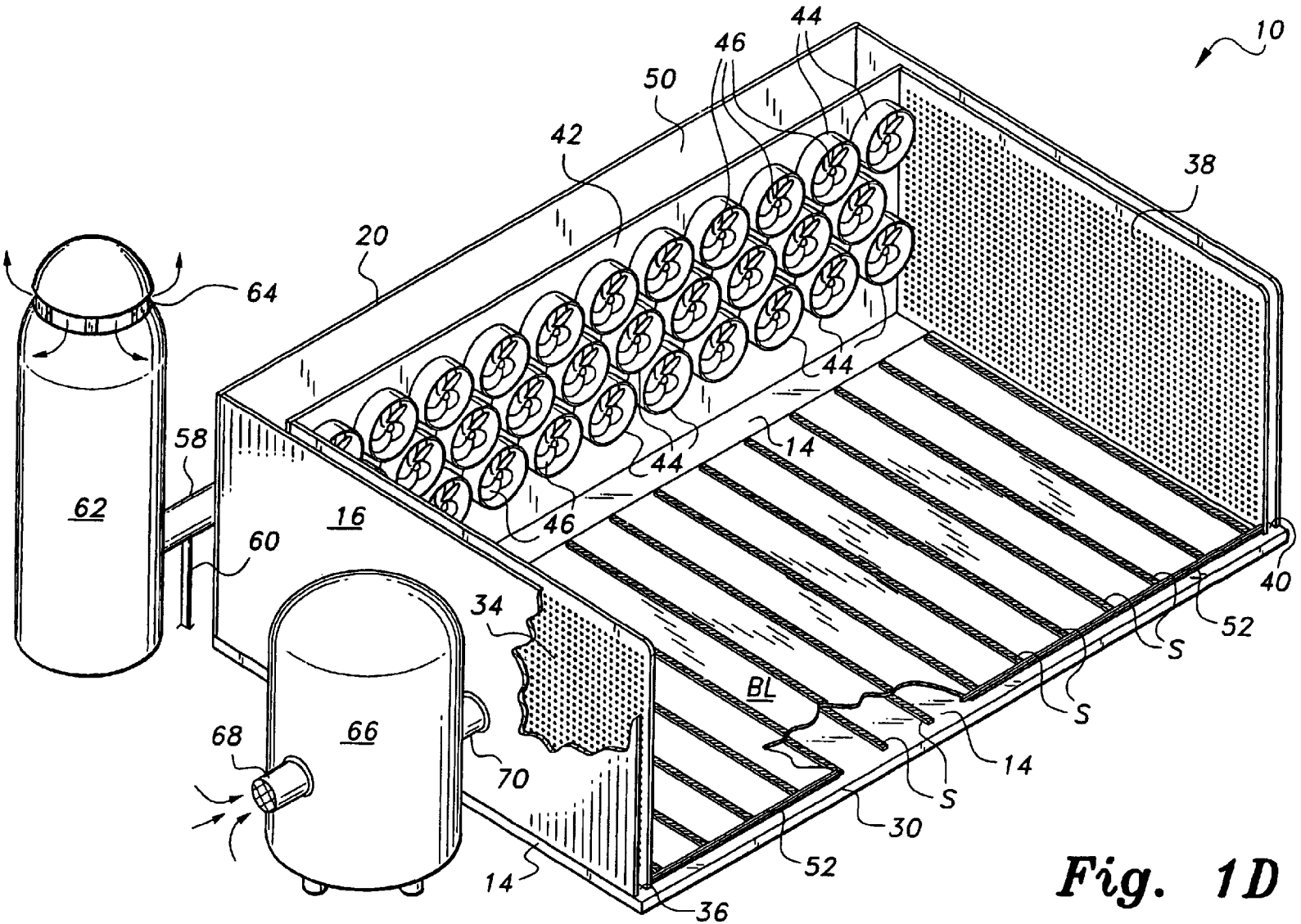
FIG. 1D is a perspective view of the kiln of FIG. 1C with the cover removed and the fan support wall partially broken away illustrating the stickers and bottom lumber layer.

Referring to FIGS. 1A–1I, there is shown one embodiment of the present invention wherein stickers are used to separate the layers of lumber to be dried, the overall system being designated by reference number 10. Vacuum lumber drying kiln system 10 includes a kiln 12 having a planar base 14, a left endwall 16, a right endwall 18, a rear wall 20, and a flexible cover 22 having an upper portion 24 and a front portion 26. Cover 22 has a base end 28 for sealing against affront ledge 30 of base 14. As seen in FIGS. 1C and 1D, left inner perforated wall 34 is spaced inward from left end wall 16 forming left side plenum 36. Right inner perforated wall 38 is spaced inward from right end wall 18 forming right side plenum 40. Kiln fan support wall 42 extends between the rear ends of left and right inner perforated walls 34 and 36, respectively and is spaced forward of rear wall 20 forming a rear chamber 50 in communication with left plenum 36 and right plenum 38, the perforated walls, the fan support wall and the flexible cover forming a drying chamber for a stack of lumber.

Figure 1E:
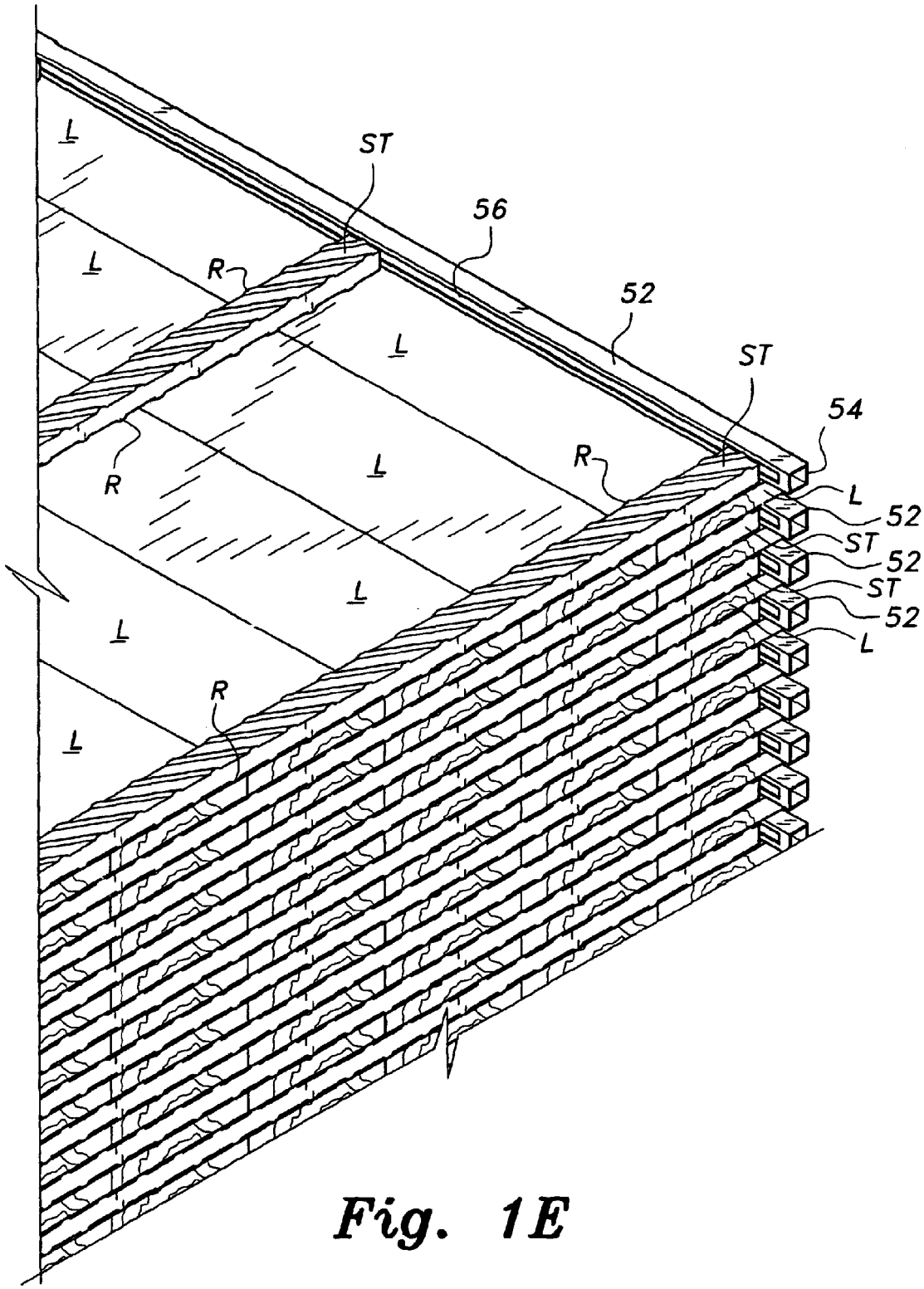
FIG. 1E is a detail view of the lumber stack of FIG. 1C with lumber in crosswise position.
Figure 1F:
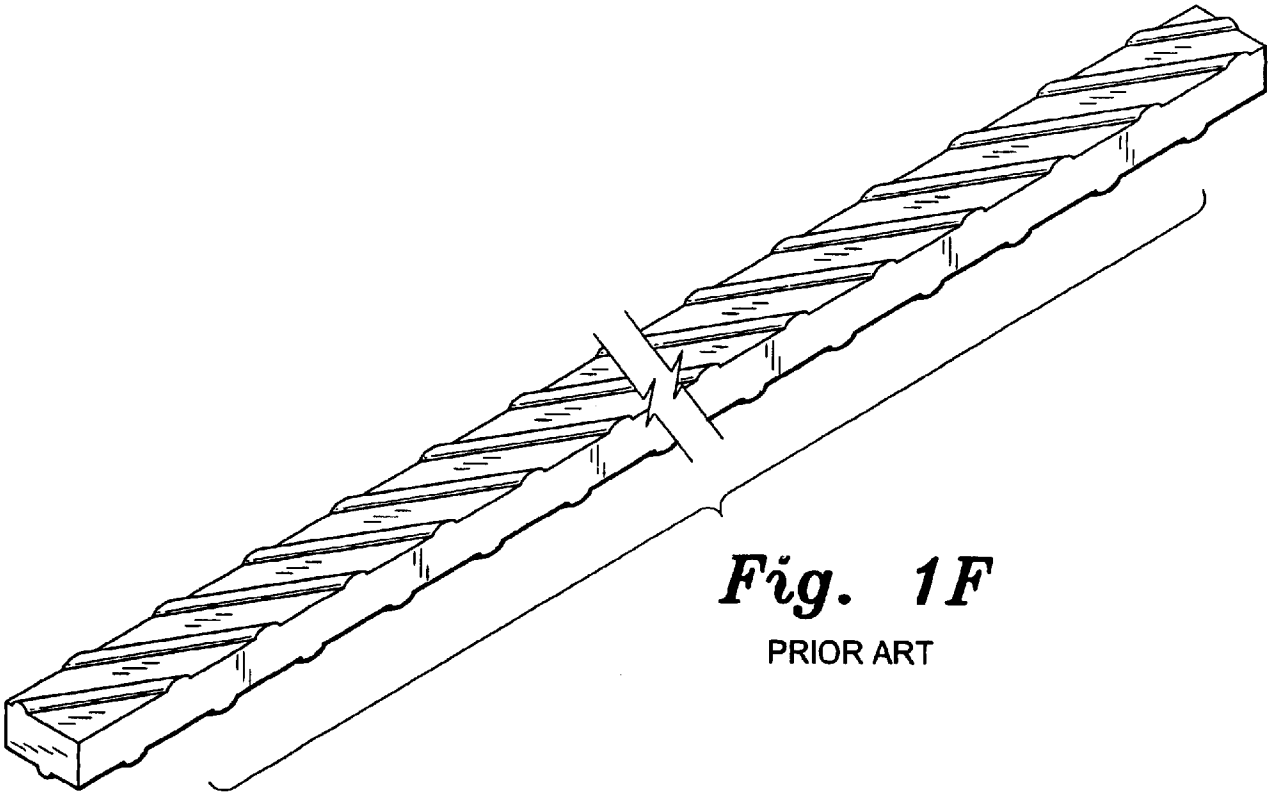
Fig. 1F PRIOR ART
FIG. 1F is a perspective view of the sticker of FIG. 1E.
Figure 1G:
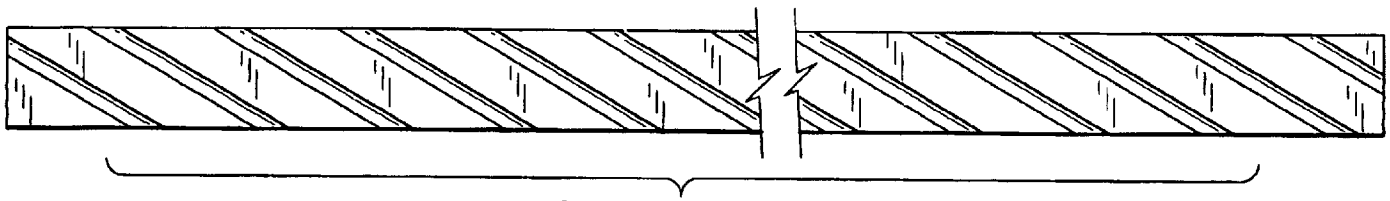
Fig. 1G PRIOR ART
FIG. 1G is a plan view of the sticker of FIG. 1F.

Fan ducts 44 are supported by support wall 42 in which fans 46 operate to circulate air and steam from the stack of lumber being dried to the rear chamber 30, back into plenums 36 and 40 and through corresponding perforated walls 34 and 38 and back into the lumber stack. As seen in FIG. 1E, spacing and circulation tubes 52 are placed along the front of the lumber stack between layers of lumber L. Circulation tubes 52 are preferably rectangular or square in cross section, having open ends 54 and an inner slot 52 placed to communicate with the spaces between layers of lumber L and stickers ST. As seen best in FIGS. 1G and 1H, stickers ST have crosswise ridges on both upper and lower surfaces so as to allow flow of air and steam through the interstices formed by the ridges and the layers of lumber L. The circulation tubes 52 and stickers ST allow the maintaining of a flow of air and steam through the stack through each side and to the rear to be circulated by fans 46 as described above.

Vacuum header 58 is connected with rear wall 20 by conduits 59 and connects vacuum pump 62 with kiln 12 for pulling a vacuum therein, the air and steam being exhausted from vacuum pump 62 at exhaust 64. Heated air is supplied to plenums 36 and 40 through one or both endwalls from heaters 66 having inlet air conduits 68 and heater-to-endwall conduits 70 (one air heater is shown in FIG. 1C). One heater 66 may be sufficient, depending on the size of the stack being dried. As seen in FIG. 1D, base lumber layer BL is separated from base 14 by stickers S or other means. A support layer of flat material may be used in place of drying lumber as desired to facilitate the loading of a green stack and the removal of the dried stack of lumber by a fork lift or similar device(not shown).

In operation, a stack of lumber L is placed in the kiln 12 between perforated walls 34 and 38. Flexible cover 22 is unrolled from a rolled position as shown in FIG. 1C to a covering position as shown in FIGS. 1A and 1B in which cover 22 seals against end walls 16 and 18, and rear wall 20.

Figure 1H:
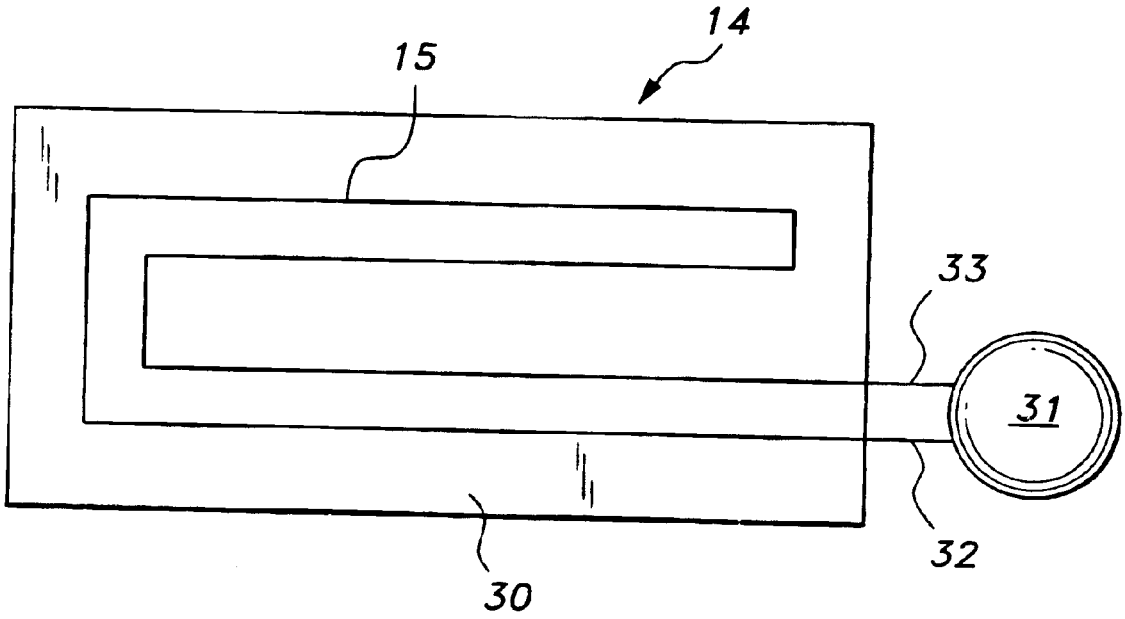
FIG. 1H is a diagrammatic plan view of the heated base and heating system of FIG. 1A.
Figure 1I:
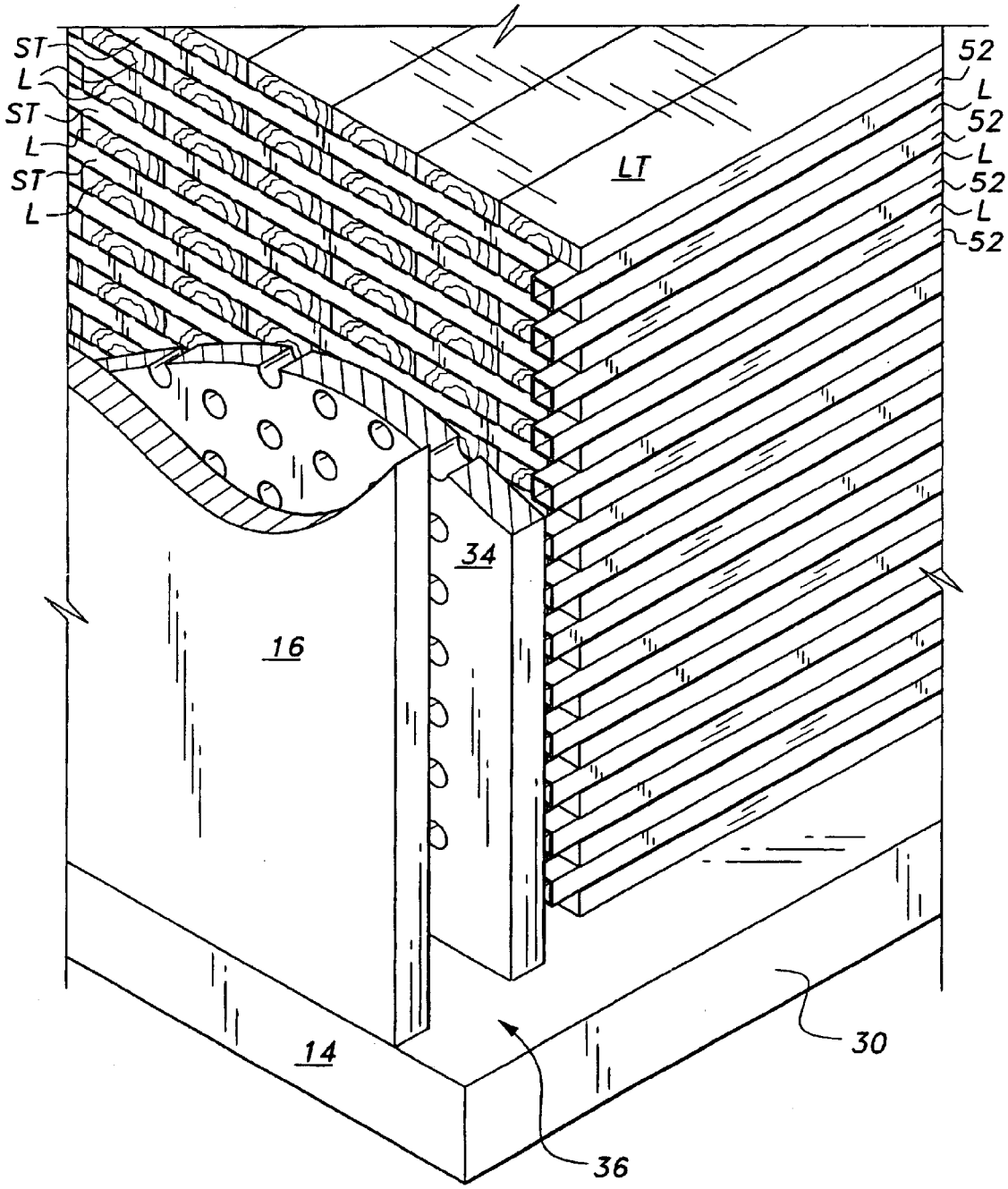
FIG. 1I is a detail cutaway view of the kiln of claim 1 showing the spaced walls and lumber stack of FIG. 1C.

The cover base end 28 seals against cover base front ledge 30. The height of the lumber stack should be such that the top lumber layer LT is about even with the upper edge of the end and back walls so as to support the upper portion 24 of flexible cover 22 while maintaining a seal with the walls. The front of the lumber pile and spacing and circulation tubes 52 should form a flat vertical front face for the lumber stack as shown in FIGS. 1C and 1I about even with the front edge of end walls 16 and 18 so as to keep the front portion 24 of flexible cover 22 from collapsing inward when a vacuum is pulled on the kiln.

Flexible cover front portion 24 seals against the front edges of endwalls 16 and 18 and against base front ledge 30 at cover base end 28. Flexible cover front portion 24 may also seal against the front edges of perforated inner walls 34 and 36. Upon pulling a vacuum on kiln 12 by vacuum pump 62, the various seals are strengthened by the outside air pressure. Any condensate in the vacuum header 58 may be drained through drain 60. Heated air is supplied to kiln 12 by air heaters 66 to plenums 36 and 40 and circulated through perforated endwalls 34 and 38 into the lumber stack.

The flow of heated air to the kiln may be controlled by the capacity of the air heaters or by valves such as air control valves 72 (see FIG. 1B). As described above, the heated air penetrates the stack through the passages between the stickers S and the lumber L and circulates through the stack and into back chamber 50 by fans 46. A vacuum is pulled within kiln 12 by employing, a vacuum pump 62 having a large capacity such as to maintain a desired level of vacuum while adding hot air to the kiln from heaters 66 to maintain a desired temperature level in the kiln. Heat may also be added by providing a heated base 14 as illustrated in FIG. 1H where hot water pipe 15 runs through base 14. Hot water heater 31 provides hot water through supply line 32 to pipe 15 where heat is given up to base 14 and the lower temperature water is circulated back to heater 31 for reheating (conventional circulating pumps are not shown) The base 14 may be heated by alternative means such as by steam or electrical power in a conventional manner. The kiln is then operated until the desired moisture level in the lumber L is obtained, at which time the vacuum pump is shut down, the flexible cover 22 is removed and the lumber unloaded. The kiln walls and base are preferably made of stainless steel to avoid corrosion by acids escaping from the wood.

Referring to FIGS. 2A–2K, there is shown a variation of the inventive embodiment of FIGS. 1A–1I, above, wherein heated plates are employed for contact heating of the wood stack to be dried. Vacuum lumber drying kiln system 10 includes a kiln 12 having a planar base 14, a left endwall 16, a right endwall 18, a rear wall 20, and a flexible cover 22 having an upper portion 24 and a front portion 26. Cover 22 has a base end 28 for sealing against a front ledge 30 of base 14. The base, the endwalls, the rear wall, and the flexible cover forms a drying chamber for a stack of lumber.

Figure 2A:
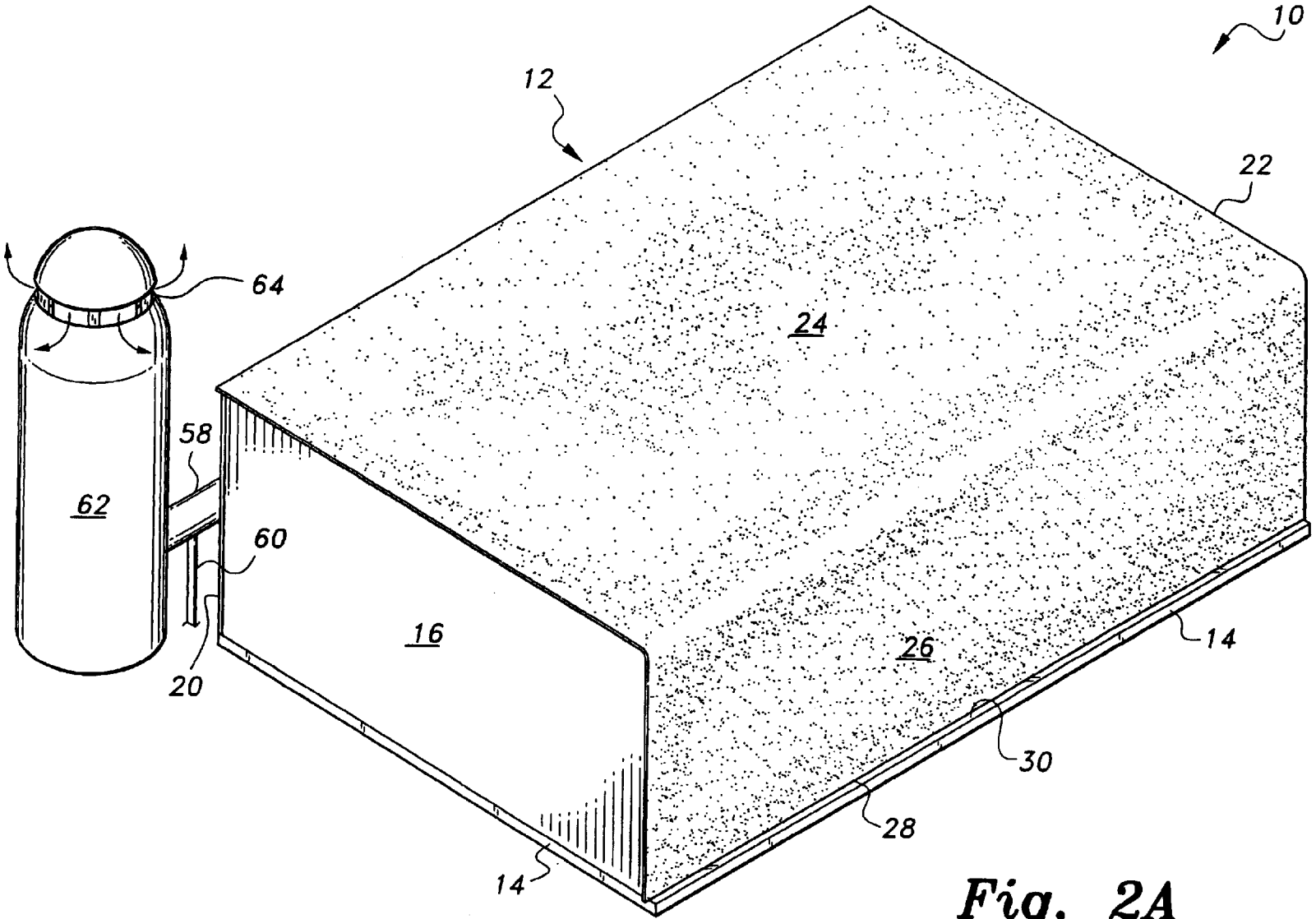
FIG. 2A is a perspective view of another embodiment of the present invention.
Figure 2B:
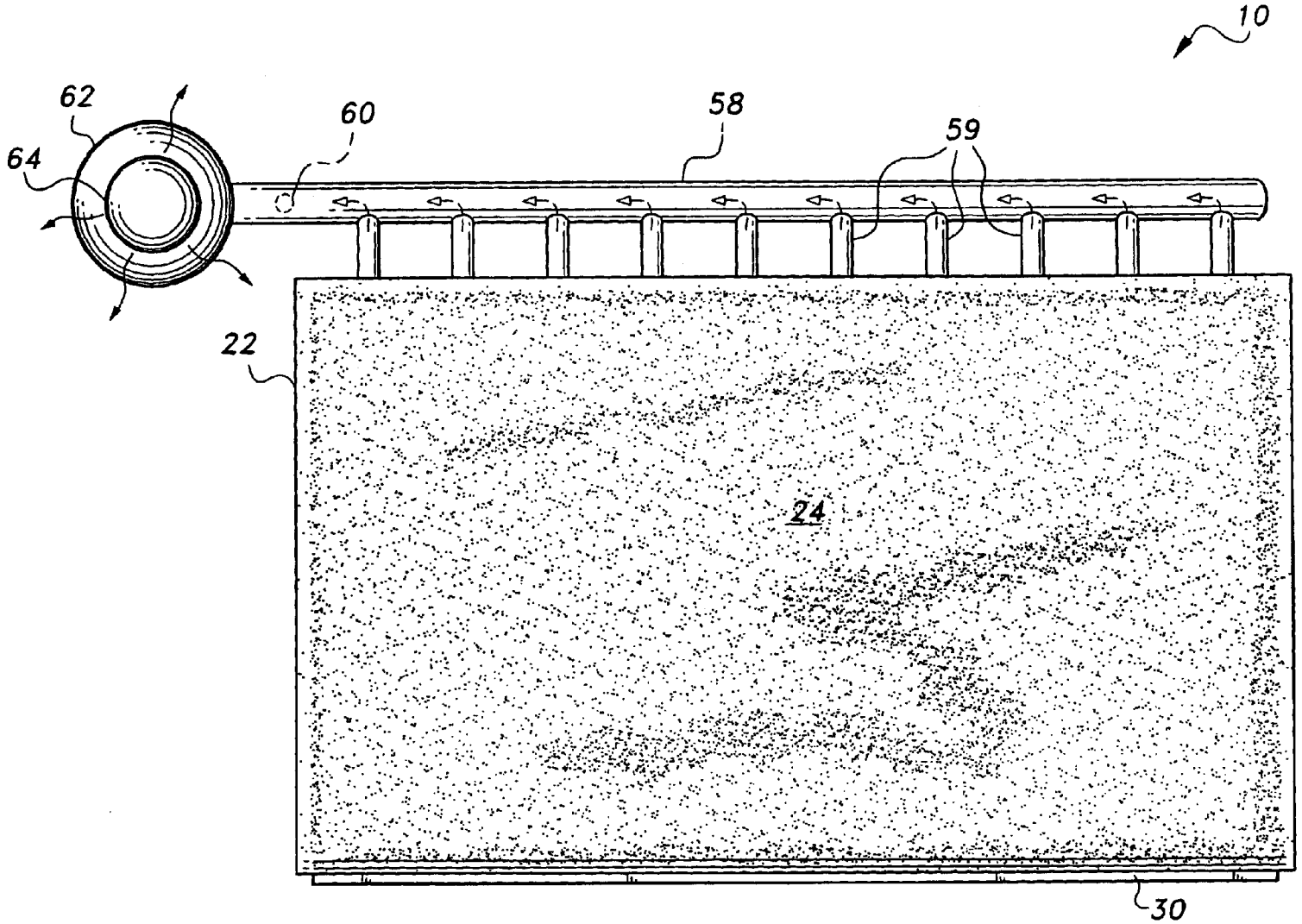
FIG. 2B is a plan view of another embodiment of the present invention.
Figure 2C:
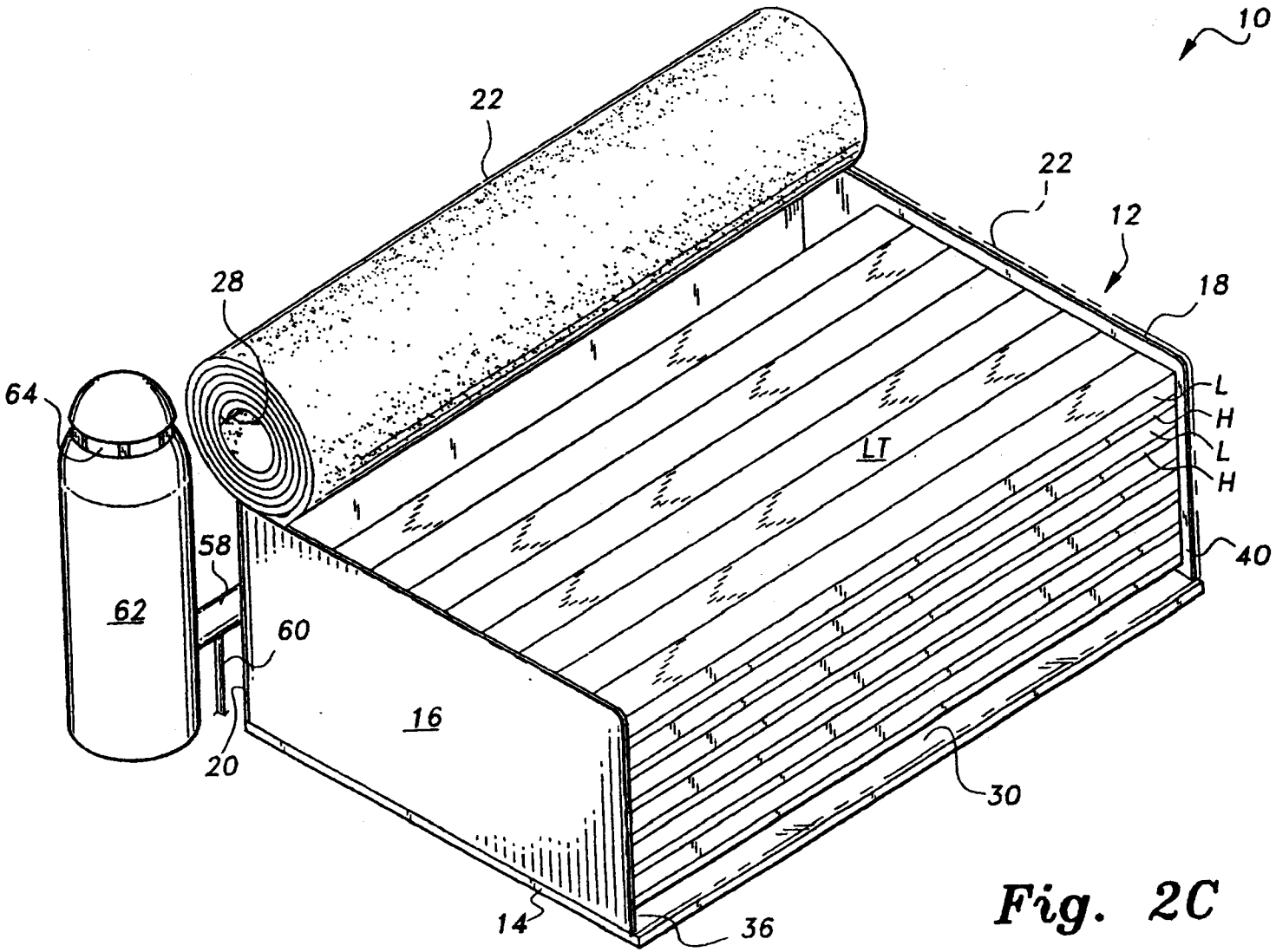
FIG. 2C is a cut away detail perspective view of the embodiment of FIG. 2A similar to that of FIG. 1C.
Figure 2D:
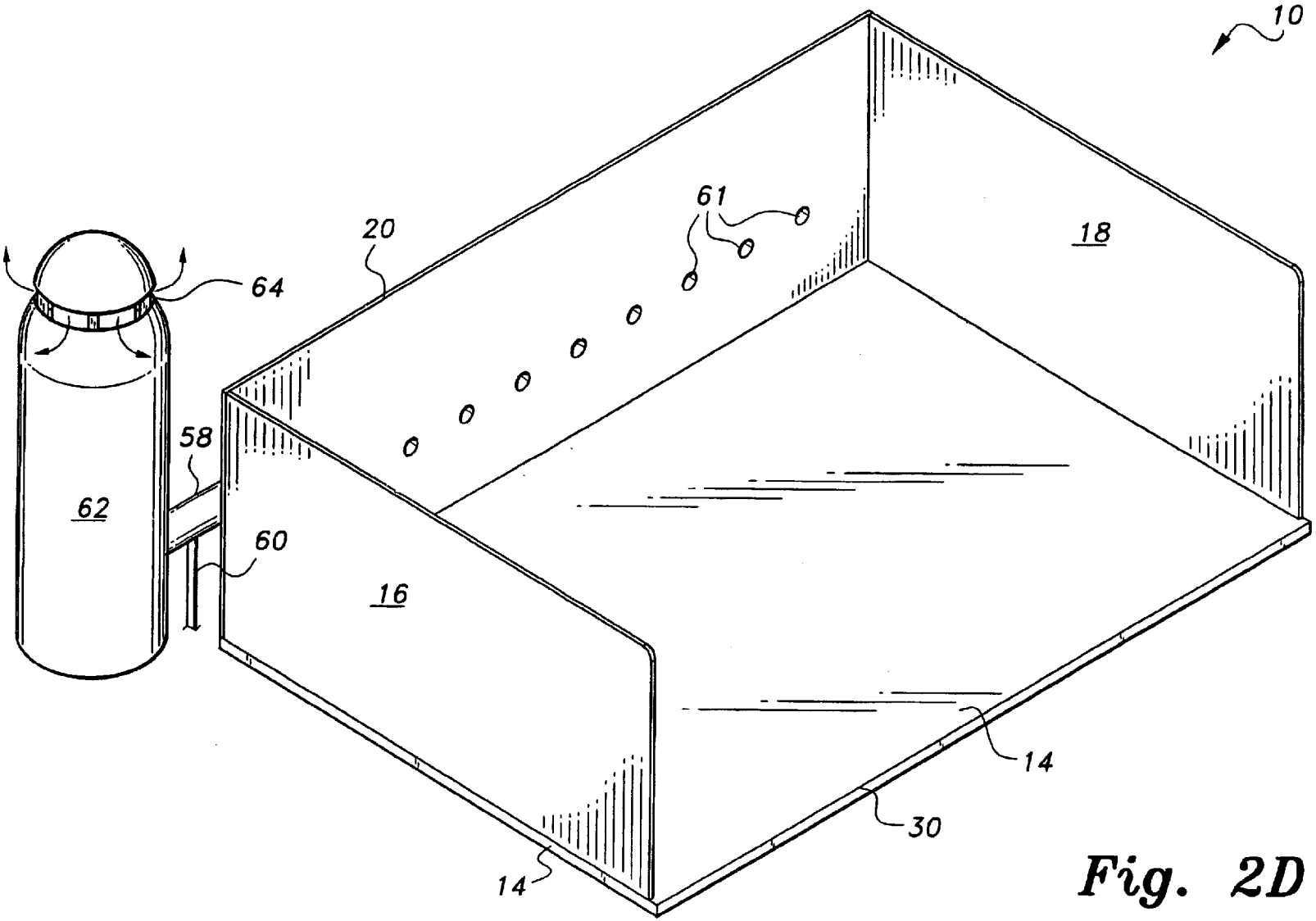
FIG. 2D is a cut away detail perspective view of the embodiment of FIG. 2A without the stack of lumber and hot plates.

As seen in FIGS. 2B and 2D, vacuum pump 62 pulls a vacuum on kiln 12 through header 58 and conduits 59 which open into the vacuum chamber through rear wall 20 at manifold apertures 61, expelling air and/or steam through vacuum pump exhaust 64, any liquid condensed in header 58 being drained through liquid drain 60. It is noted that liquid may only be drained when a vacuum does not exist in the system, a valve of conventional construction (not shown) being shut to allow the pulling of vacuum on the system. A stack of lumber L is formed by alternating heating plates B and layers of lumber L. The stack may be supported on the floor of base 14 in a manner to allow a stack to be removed from kiln 12 by a forklift as desired.

Figure 2E:
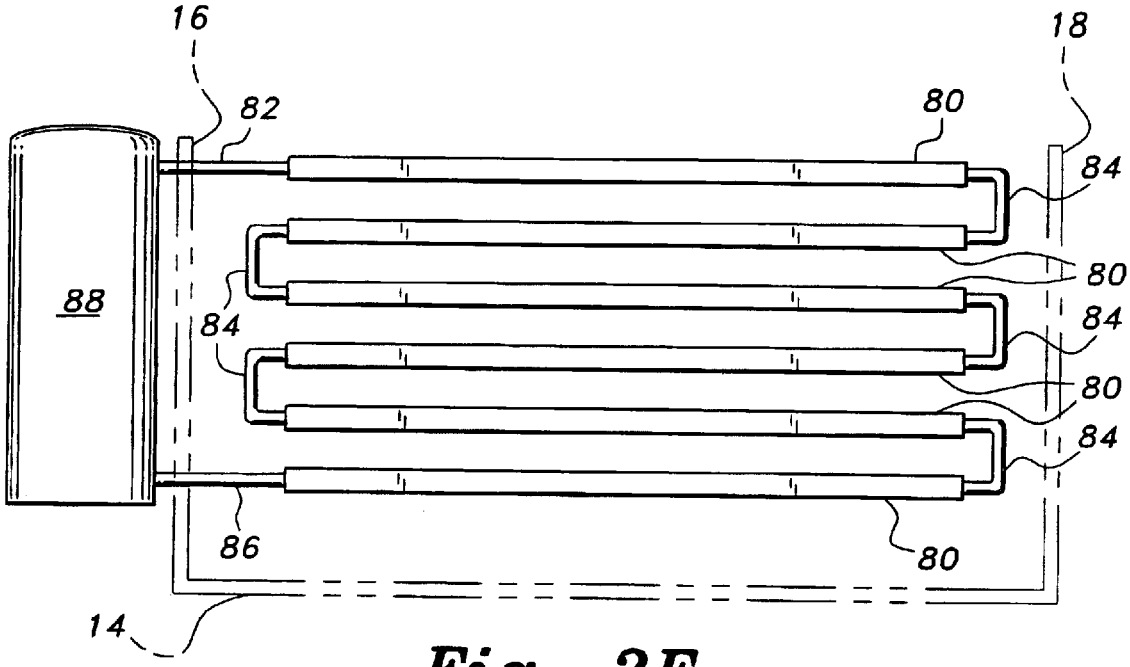
FIG. 2E is a diagrammatic elevation view of hot water heated hot plate system of the embodiment of FIG. 2A.
Figure 2F:
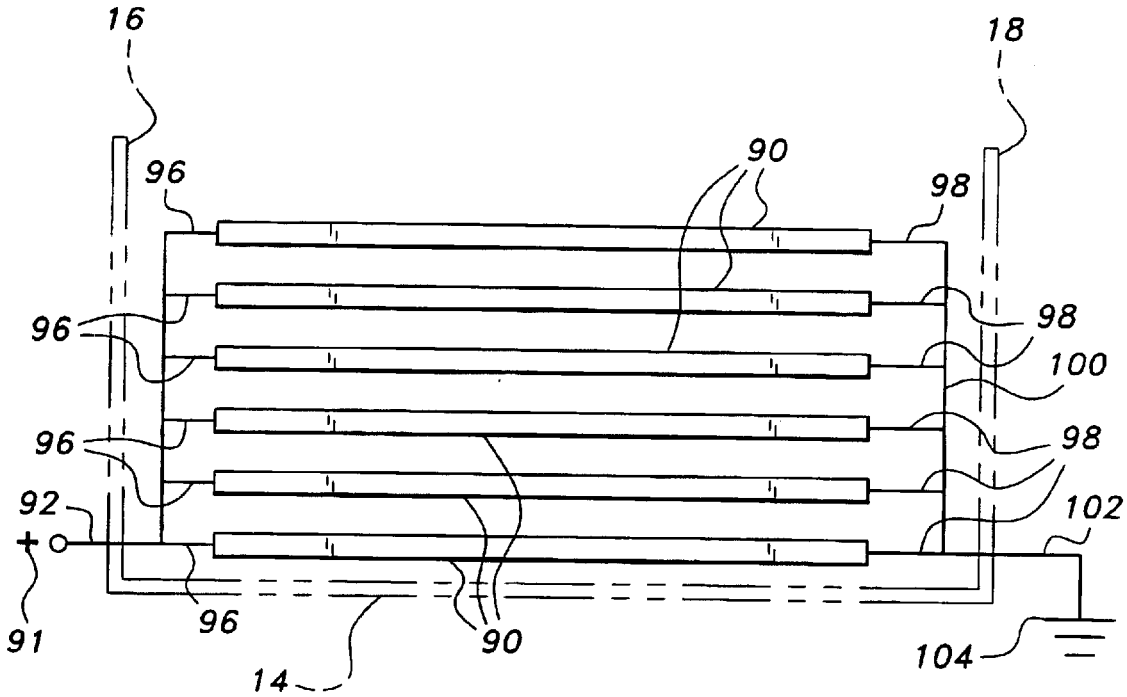
FIG. 2F is a diagrammatic elevation view of an electrically heated hot plate system of the embodiment of FIG. 2A.
Figure 2G:
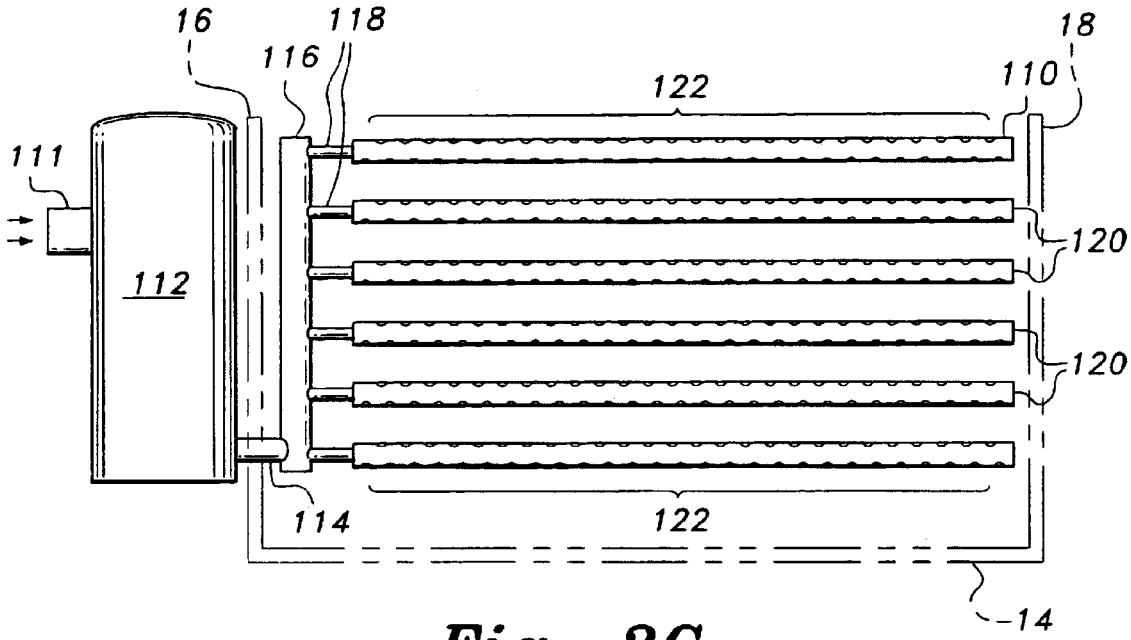
FIG. 2G is a diagrammatic elevation view of hot air heated hot plate system of FIG. 2A.
Figure 2H:
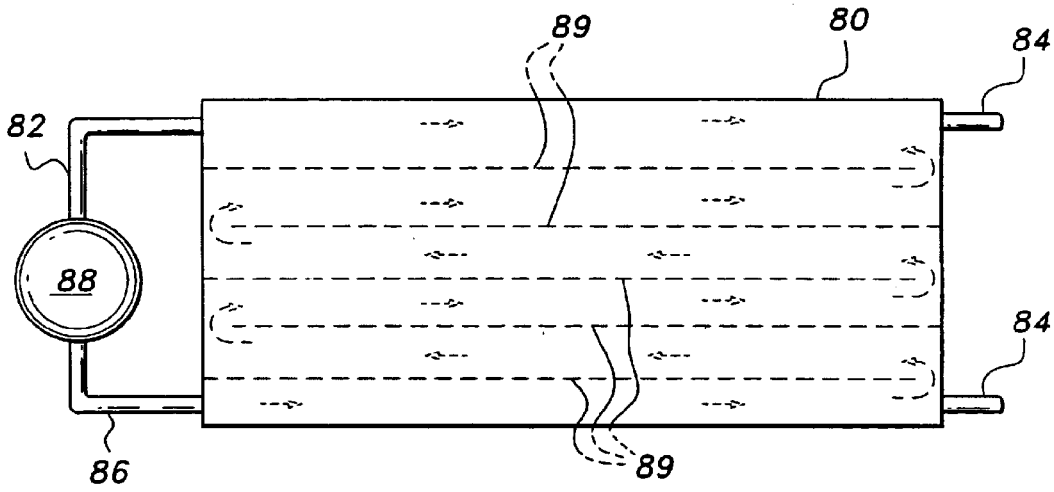
FIG. 2H is a plan view of the hot water heated hot plate system of the embodiment of FIG. 2E.

Referring to FIGS. 2E and 2H, there is diagrammatically shown a hot water heating system (the intervening layers of lumber between the plates not shown) for a hot plate system where hollow hot plates 80 are supported between lumber layers (not shown) for contact heating of the lumber while a vacuum is pulled on the system. Hot water supply line 82 enters the kiln 12 through endwall 16 and supplies hot water to a series of hot plates 80 which are fluidly connected by plate-to-plate conduits 84(convention connections not shown), the cooler water being removed from the lower plate through endwall 16 and returned to water heater 88 for heating and circulation back to the upper hot plate 80(any conventional control valves and circulating pumps are not shown and form, in themselves, no part of the present invention). The hot plates may, alternatively, be fed hot water in parallel by a header as desired.

As seen in FIG. 2H, internal baffles 89 may direct the hot water through the hot plate 80 and help support the hot plate structure. In the case where the base 14 is heated, appropriate hot water lines may be run from heater 88 for circulation through base 14 as shown in FIG. 1I, above. Heated air is not required for this embodiment and steam and structure such as circulating fans and perforated end walls is not required for carrying out the drying process. The contact of the hot plates with the lumber drives off steam as vacuum is pulled, the steam being removed from the kiln by vacuum pump 62.

Figure 2I:
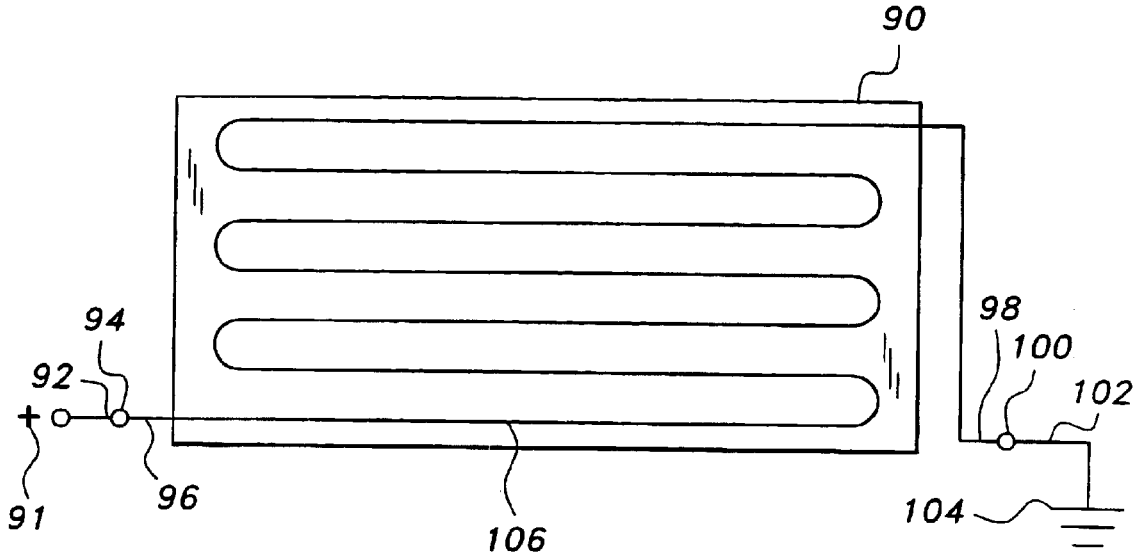
FIG. 2I is a plan view of the electrically heated hot plate system of the embodiment of FIG. 2F.

Referring to FIGS. 2F and 2I, there is shown a diagrammatic hot plate system similar to that above, however the plates are electrically heated, wherein electrically heated plates 90 are provided electrical power from power source 91 through supply line 92 to electric power distribution line 94 feeding electric power parallel plate supply lines 98 where heating takes place by electric heating elements 106. The electrical circuit is completed by parallel ground lines 98 leading to ground line 102 and then to ground 104. The hot plates may, alternatively, be heated in a series circuit as desired. Power source supply line 92 and ground line 102 are shown entering and exiting the kiln 12 through endwalls 16 and 18, but may be otherwise routed into the kiln as desired. The base 14 may also be electrically heated if desired, or heated by a hot water system as described above, the heating of the base not being critical to the operation of the kiln 10.

The steam emanating from the lumber as heated by the above-described hot plates seeps to the outside of the stack through interstices between the pieces of lumber in the stack and is then removed by the vacuum system.

Figure 2J:
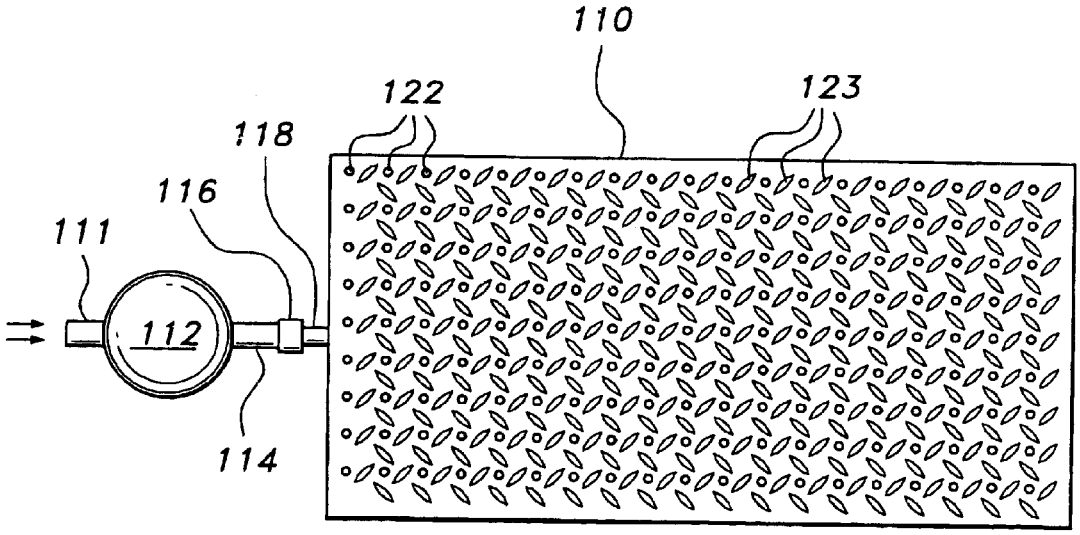
FIG. 2J is a plan view of the hot air heated hot plate system of FIG. 2G.
Figure 2K:
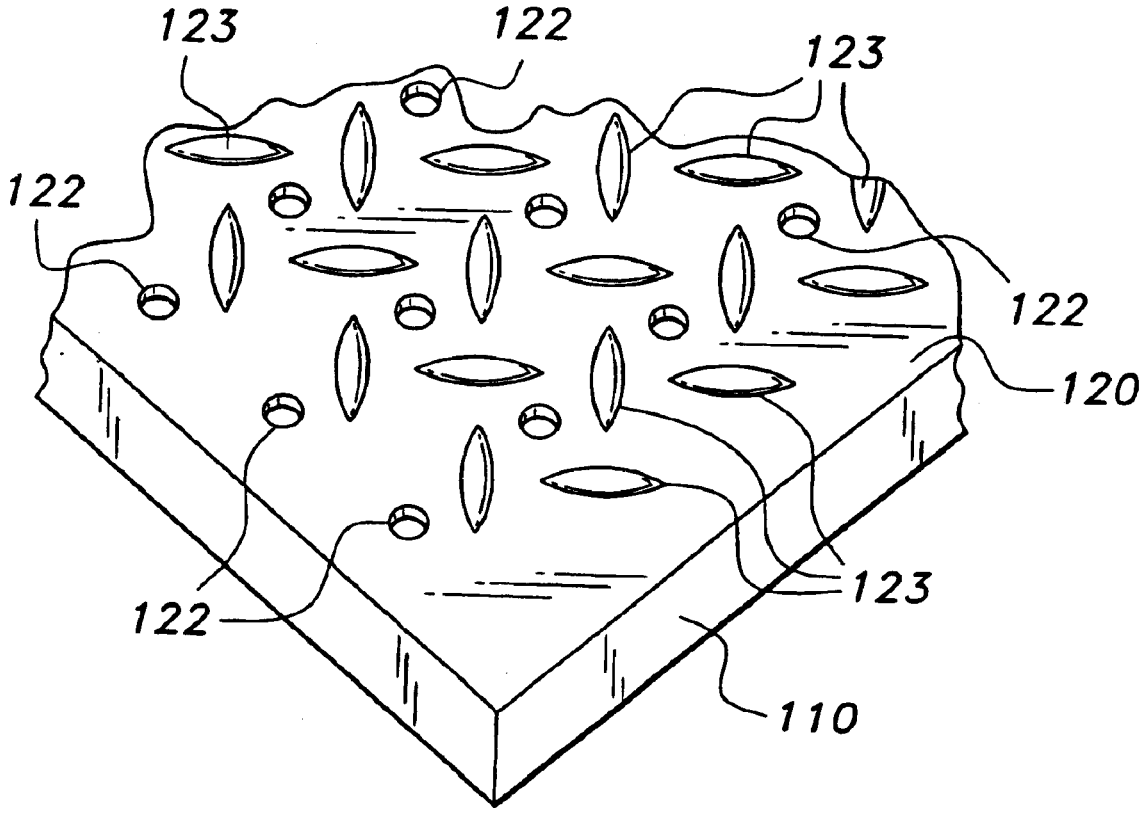
FIG. 2K is a detail view in perspective of the hot air heated hot plate of FIG. 2G.

Referring to FIGS. 2F and 2J there is shown another hot plate system where heat is provided to the hot plates by hot air provided by an air heater similar to that of the first embodiment above. The plates are placed in parallel between layers of lumber to be dried, the plates having orifices for flow of heated air into the stack of lumber. Air heated perforated plates 110 are provided heated air from inlet air heater 112 having an inlet outside air conduit 111 and supplying heated air through conduit 114 to a hot air manifold 116. The hot air manifold is shown within the kiln 12, but may be outside endwall 16 as desired. Perforated hot plates 120 are fed hot air by supply conduits 118 and the heated air then travel through hot plates 120 and out the perforations in the upper and lower walls of the hot plates, the perforations being of such sized and number to act as orifices which provide a substantial pressure drop into the kiln vacuum volume during operation. The hot air and steam then escapes the stack between the hot plates and the lumber layers by means of passageways formed by ridges 123 extending above and below the plate surface.

The vacuum pump 62 is of large capacity and maintains a desired vacuum level in the kiln 12 due to a selected low hot air supply rate and pressure drop through the perforations in the hot plates which is reached when the kiln is operated under stable conditions during the drying process. If desired, steam and warm air removed by vacuum pump 62 may be run through a condenser (not shown) and the air recycled to the heater. Heat may also be recovered from the condensate by well-known means. The base 14 may also be heated in a manner described above as desired. The heated air plate system is desirable in the air is available to help sweep the steam released from the wood out of the stack and into the vacuum pump, thus reducing drying time.

Figure 3:
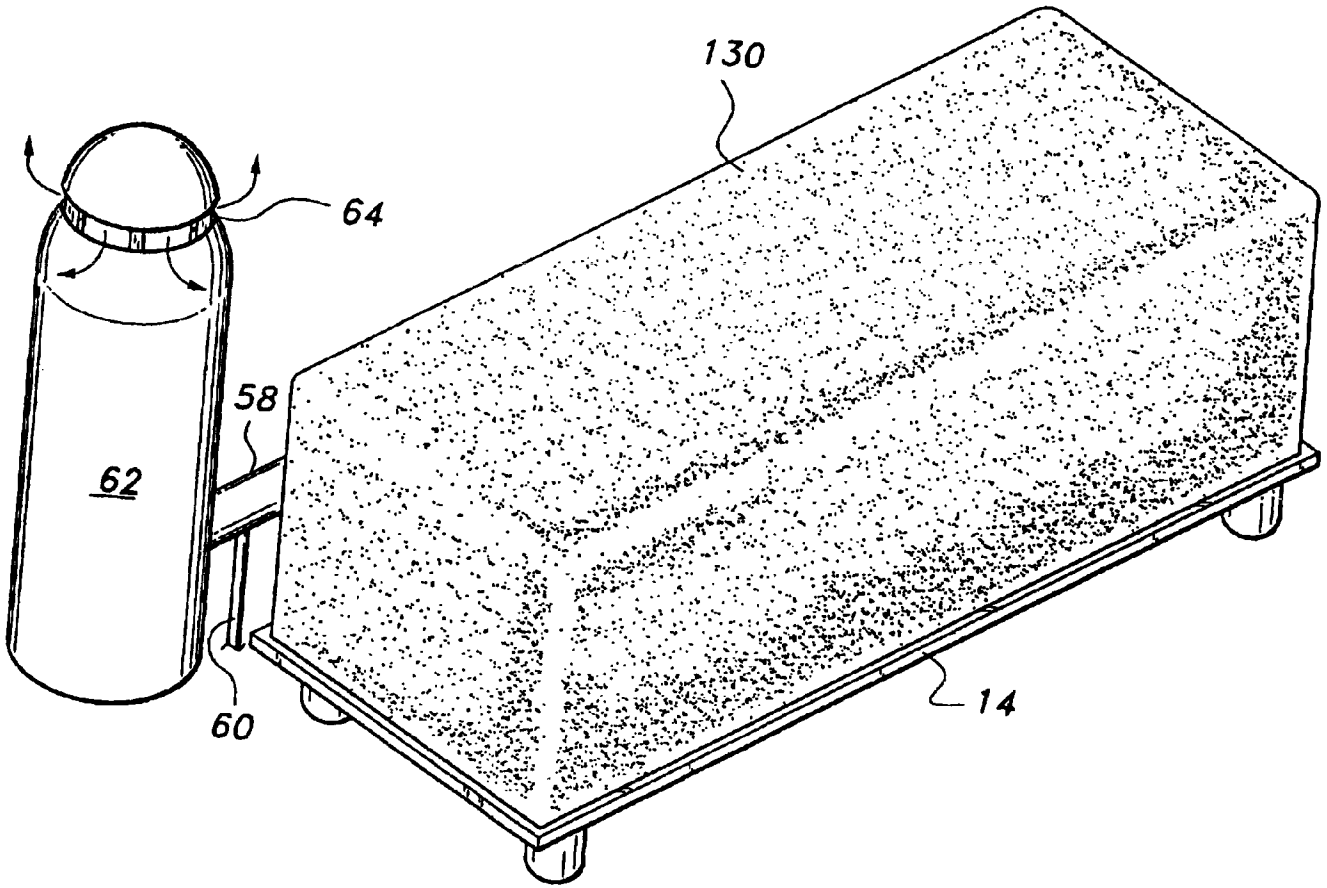
FIG. 3 is a perspective view of a simplified embodiment of the vacuum kiln of the present invention for use by a small drying operation.

Referring to FIG. 3, there is shown another variation,on the embodiment of FIGS. 1A–1I, particularly adapted for smaller kiln operations wherein the stack of wood to be dried is completely covered by a flexible cover 130 which seals against base 14 on the front, rear, and ends thereof upon pulling vacuum on the system through header 58 attached to the rear of the flexible cover (not shown) by vacuum pump 62. Each side of the base 14 acts as a ledge for sealing against the lower edge of cover 130. This system is particularly adapted for use with hot plates as described above in the embodiment of FIGS. 2A–2K and the base 14 may be heated in a manner as described above.

The preferred material for the flexible cover material is Nylon-reinforced rubber or other strong, flexible material. The metal components of the system, including the floor, walls, headers, etc. are preferably made of stainless steel to resist the action of acids from the treated wood.

It is to be understood that the present invention is not limited to the embodiments described above, but encompasses any and all embodiments within the scope of the following claims.

I claim:

1. A vacuum lumber drying kiln for drying a stack of lumber, comprising:

a planar base having at least one ledge including a front ledge;

a flexible cover having a sealing base end and covering the stack of lumber forming a kiln;

said sealing base end being sealed to said planar base at said at least at least one edge;

means for supplying heat to said kiln; and a vacuum pump fluidly connected with said flexible cover;

said flexible cover being supported by said stack of lumber such that said sealing base end seals against said base upon activation of said vacuum pump, thereby creating a vacuum within the drying chamber formed by said flexible cover and said planar base.

2. The vacuum kiln of claim 1, further comprising a back wall and opposing end walls, said flexible cover being attached to said back wall and extending around the upper and front periphery of said end walls, said sealing base extending to said planar base at said front ledge, said flexible cover sealing against said back wall, said end walls and said front ledge upon activation of said vacuum pump, thereby creating a vacuum within the drying chamber formed by said flexible cover, said back wall, said side walls, and said planar base.

3. The vacuum kiln of claim 2, further comprising a heater having an air intake and a kiln supply conduit, said kiln supply conduit being operatively connected with at least one of said side walls for supplying heated air to said drying chamber formed by said walls, flexible cover, and planar base, said vacuum pump having a greater flow capacity than said kiln supply conduit so as to maintain said drying chamber in a vacuum condition.

4. The vacuum kiln of claim 3, further comprising perforated inner walls conforming to and spaced inward from said side walls, said side walls and said perforated inner walls defining at least one plenum therebetween for even distribution of heated air from said air heater to the drying chamber formed by said perforated walls, flexible cover, and planar base.

5. The vacuum kiln of claim 4, further comprising a fan support wall spaced inward from said back wall forming a rear chamber and a supporting plurality of ducted fans, said fan support wall supporting said ducts and said fans for drawing air and steam from said drying chamber and exhausting said air and steam into said rear chamber for removal by said vacuum pump.

6. The vacuum kiln of claim 5, wherein there is a plenum formed between each opposing wall and the respective perforated wall and said ducts are sealed to said fan support wall making said rear chamber a connecting chamber between said plenums for fluid communication therebetween.

7. The vacuum kiln of claim 6, further comprising a manifold attached between said rear wall and said vacuum pump and in fluid communication therewith for removing said air and steam from said kiln to the atmosphere.

8. The vacuum kiln of claim 7, wherein said lumber stack is separated into layers by stickers having ridges thereon for providing circulation of air and steam between said layers of lumber.

9. The vacuum kiln of claim 8, further comprising a plurality of spacing and circulation tubes having open ends and slotted inner sides, said spacing and circulation tubes being located along the front of said lumber stack between each layer of lumber, said slotted inner sides facing inward into the stack such that air and steam may flow between spaces between the lumber layers partitioned by said stickers.

10. The vacuum kiln of claim 9, said planar base being a heating base connected with a source of heat.

11. The vacuum kiln of claim 2, further comprising heating plates located between each respective layer of lumber in said stack of lumber.

12. The vacuum kiln of claim 11, said heating plates being heated by hot water flowing therethrough and further comprising a water heater, a hot water supply conduit fluidly connected between said water heater and an upper heating plate, a water return conduit connected between a lower heating plate and said water heater, and intermediate plate to plate conduits connecting each respective heating plate in turn, whereby water circulates between said water heater where it is heated, said upper heating plate, said intermediate plates, and said lower plate where heat is transferred to the layers of lumber, and back to said water heater for heating.

13. The vacuum kiln of claim 12, wherein said heated base has a hot water conduit therein and said means for heating said base are said water heater, a hot water supply conduit connected between said water heater and said hot water conduit, and a water return conduit connected between said hot water conduit and said water heater.

14. The vacuum kiln of claim 12, wherein said heating plates are electrically heated.

15. The vacuum kiln of claim 12, wherein said heating plates are hollow and have perforated upper and lower surfaces, said vacuum kiln further comprising an air heater having an air supply, an air inlet conduit, and a manifold having plate air supply conduits connect to said heating plates, respectively.

16. The vacuum kiln of claim 12, said planar base being a heating base connected with a source of heat.

17. The vacuum kiln of claim 11, said flexible cover covering the stack of lumber on all four sides, i.e., the back, each end, and the front side, said planar base having four sides serving as ledges for sealing against the cover base end of said flexible cover, said flexible cover being of such height relative to said stack of lumber as to exact atmospheric pressure upon the top lumber layer of the stack upon pulling a vacuum on said kiln.

18. A method of drying a stack of lumber comprising:

placing a stack of lumber on a kiln base;

placing a flexible cover over said stack of lumber and sealing said flexible cover to said kiln base;

pulling a vacuum on said flexible cover as sealed to said kiln base;

providing heat to said kiln while drying said lumber;

wherein said flexible cover transmits atmospheric pressure to the upper layer of said stack of lumber upon the pulling of said vacuum, thereby maintaining the lumber in a straight, uncupped condition during drying.

19. The method of claim 18, wherein said heat is provided by hot plates distributed between layers of said lumber in said stack, thereby providing heat to said lumber by direct contact and conduction from said hot plates.

20. The method of claim 18, wherein heated air is provided to said stack of lumber, as separated by stickers, said heated air and steam from the lumber being recirculated through said stack of lumber during the drying process.

* * * * *